United States Patent [19]

Elias-Reyes

[11] Patent Number: 4,734,067

[45] Date of Patent: Mar. 29, 1988

[54] HYDRO-ROTOR

[76] Inventor: Francisco Elias-Reyes, 2715 U.S. 31 South, Greenwood, Ind. 46142

[21] Appl. No.: 907,811

[22] Filed: Sep. 16, 1986

[51] Int. Cl.[4] ..... B63H 1/26

[52] U.S. Cl. ..... 440/48; 416/176; 440/99

[58] Field of Search ..... 440/48, 98, 99; 114/20.1, 20.2, 337, 338; 416/176, 176 A; 290/42, 43, 53, 54; 415/72

[56] References Cited

U.S. PATENT DOCUMENTS

| | | | |
|---|---|---|---|
| 88,595 | 4/1869 | Ward | 440/48 X |
| 538,921 | 5/1895 | Lacavalerie | 440/99 X |
| 615,866 | 12/1898 | Lincoln | 440/99 X |
| 1,271,513 | 7/1918 | Lamar | 114/338 X |
| 1,798,594 | 3/1931 | Deppner | 440/48 |
| 3,050,007 | 8/1962 | Rydz | 416/176 X |

FOREIGN PATENT DOCUMENTS

| | | | |
|---|---|---|---|
| 498587 | 1/1920 | France | 440/48 |
| 258057 | 9/1926 | United Kingdom | 114/126 |

*Primary Examiner*—Sherman D. Basinger
*Attorney, Agent, or Firm*—Woodard, Emhardt, Naughton, Moriarty & McNett

[57] ABSTRACT

A hydro-rotor for providing propulsion or generating electricity in a device positioned in water. A hollow tank having a forward and aft tapered end in the preferred embodiment is mounted about a longitudinal axis to a pair of stabilizer plates. A helical flight is mounted circumferentially to the tank and extends from the forward end to the aft end of the tank. An electric motor and power source within the tank drivingly rotates the flight thereby propelling the tank through water. A pair of stabilizer plates extending outwardly of the flight and along the length of the longitudinal axis are controllingly pivoted to radial positions providing directional stability to the craft. The hydro-rotors may be rotatably mounted utilizing stabilizer plates to a ship providing propulsion therefor.

18 Claims, 8 Drawing Figures

HYDRO-ROTOR

BACKGROUND OF THE INVENTION

This invention is in the field of power systems operable in water. Propulsion systems for driving objects, such as ships, submarines and torpedoes, through the water typically have a power driven rotary propeller or screw located at the aft blunt end of the ship. The size of the propeller is relatively small as compared to the object being driven with the result that the efficiency of the driver is quite low. That is, the propeller or blade slips considerably relative to the water since the object being driven will not move as rapidly through the water due to its size and weight as compared to the object. The propeller slippage adds to the turbulence naturally caused by the aft blunt end of the object being driven thereby providing considerable noise which may be discovered by various listening devices.

Disclosed herein is a new propulsion system called hydro-rotor which includes a helical flight positioned on the circumference of the driver and having a larger outside diameter relative to the driver. As a result, the flight exhibits a high efficiency minimizing slippage of the flight surface relative to the water and maximizing the forward speed of the object being driven. Further, an object such as a torpedo or ship may be provided with a tapered forward and aft end minimizing the drag of the object resulting in exceptional low turbulence.

Instead of providing a power means for driving the flight, the principles of the invention may be utilized by directing flowing water against the flight which in turn is connected to the rotary member of an electrical generator thereby converting the rotational flight movement into electrical energy.

SUMMARY OF THE INVENTION

One embodiment of the present invention is a hydro-rotor comprising a hydrodynamically contoured tank having a longitudinal axis and being shaped with forward and rear pointed ends to provide low drag when positioned in water and relative motion exists between the tank and the water, a helical flight positioned on the tank and extending circumferentially around at least a portion thereof, the flight having an outside diameter larger than the tank, stabilizer means mounted to the forward and rear pointed ends and extendable outwardly of the flight at controlled radial positions to stabilize directional movement of the tank as the flight rotates, and power means connected to the flight to exchange energy as the flight rotates.

Yet another embodiment of the present invention is a ship comprising a ship frame, and, a plurality of hydro-rotors mounted to the ship frame and each including a hydrodynamically contoured tank having a longitudinal axis and being shaped with forward and rear pointed ends to provide low drag when positioned in water and relative motion exists between the tank and the water, the hydro-rotors each including a helical flight positioned on the tank and extending circumferentially around at least a portion thereof, the flight having an outside diameter larger than the tank, power means connected to the flight and operable to rotate same to move the ship frame.

A further embodiment of the present invention is a power generator comprising a hydrodynamically contoured tank having a generally extending longitudinal axis and being shaped with forward and rear pointed ends to provide low drag when positioned in water and relative motion exists between the tank and the water, a helical flight positioned on the tank and extending circumferentially around at least a portion thereof, the flight having an outside diameter larger than the tank, and power means mounted within the tank and connected to the flight to convert rotational energy from the flight to electrical energy as the flight is rotated by water flowing against the flight.

It is an object of the present invention to provide a hydro-rotor for propulsion purposes exhibiting high efficiency and allowing for low drag and minimum turbulence.

A further object of the present invention is to provide a hydro-rotor for converting energy from flowing water into electrical energy.

In addition, it is an object of the present invention to provide a new and improved propulsion means for various objects such as ships, submarines and torpedoes.

Related objects and advantages of the present invention will be apparent from the following description.

DESCRIPTION OF THE PREFERRED EMBODIMENTS

Figure 1:
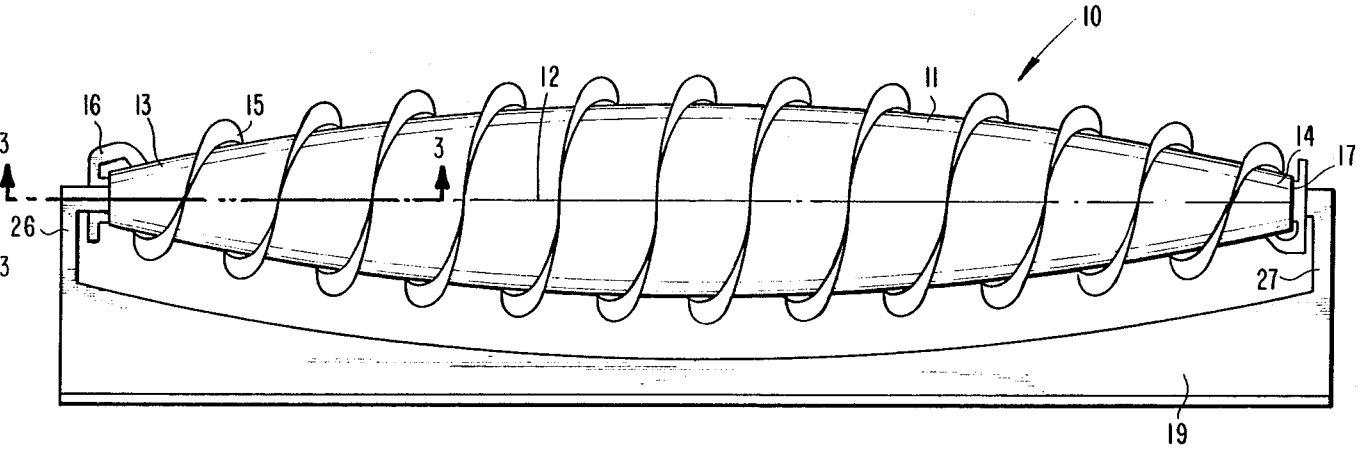
FIG. 1 is a side view of the preferred embodiment of the hydro-rotor incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
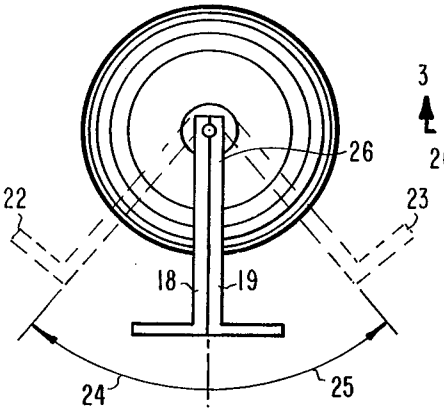
FIG. 2 is an end view of the hydro-rotor of FIG. 1.
Figure 3:
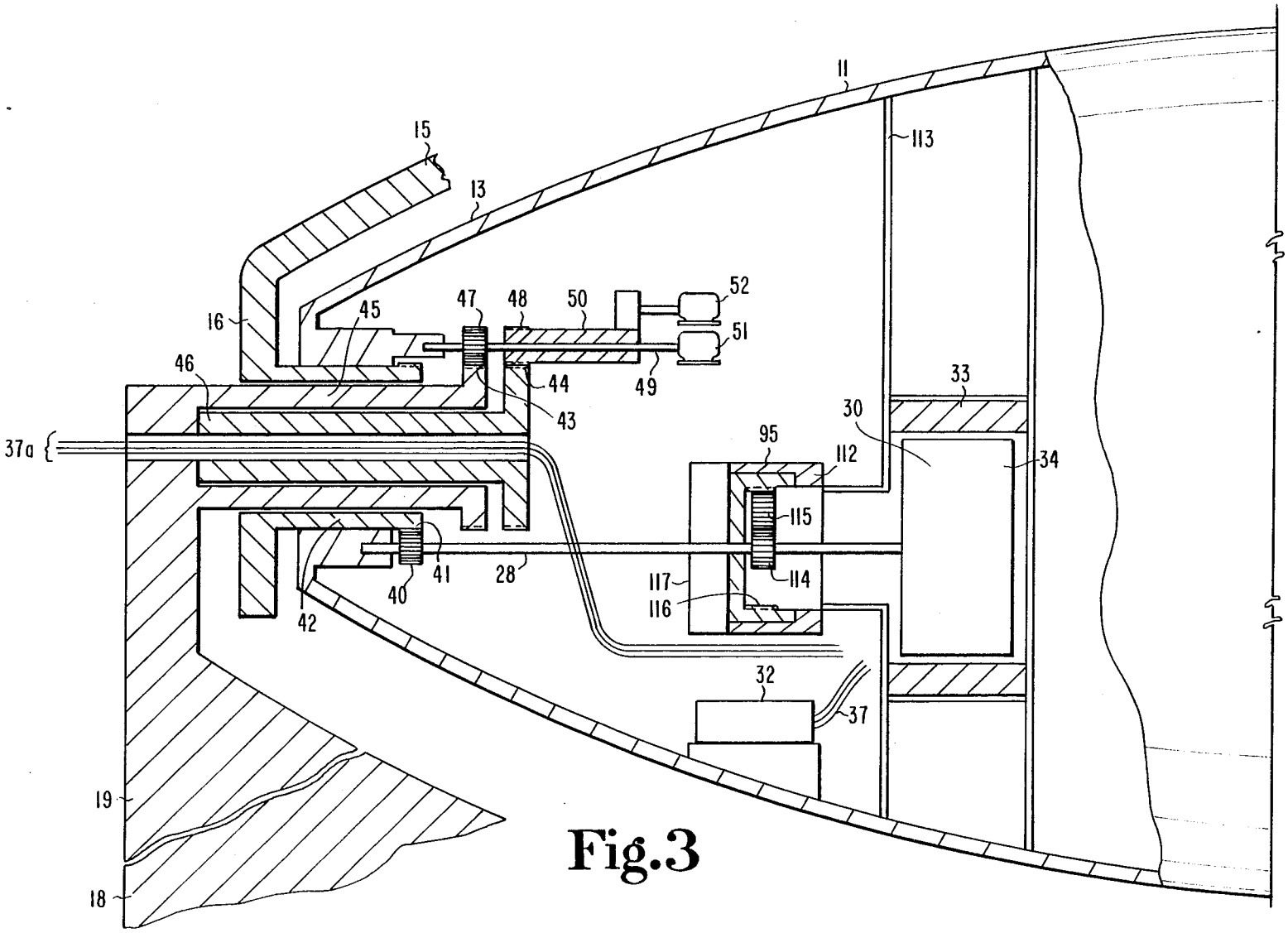
FIG. 3 is an enlarged fragmentary cross-sectional view taken along line 3—3 of FIG. 1 and viewed in the direction of the arrows, with the flight removed for purposes of clarity.

Referring now more particularly to FIGS. 1–3, there is shown the preferred embodiment of the hydro-rotor 10 incorporating the present invention. Hydro-rotor 10 includes a hydrodynamically contoured tank 11 having a longitudinal axis 12 extending centrally therethrough and along the length thereof.

Tank 10 is hollow being produced from metal or other suitable material and has a forward tapered pointed end 13 and a rear or aft pointed tapered end 14 with tank 10 being smoothly contoured between the ends and having a maximum size at the midpoint between ends 13 and 14. Tank 11 has a circular cross-section along the length of axis 12. The drag or turbulence caused by tank 11 as it moves in a forward direction along its longitudinal axis is relatively low as compared to a similar tank having a blunt or flat aft end. The tank includes a helical flight 15 extending continuously from forward end 13 to aft end 14 and has an outside diameter larger than the tank thereby extending outwardly therefrom. In the embodiment shown in FIGS. 1–3, flight 15 is spaced apart from the outside surface of tank 11 to allow relative motion between the tank and the flight.

Flight 15 has a forward end 16 located immediately adjacent and forward of end 13 of tank 11. Likewise, the flight has an aft end 17 immediately adjacent and aft of end 14 of the tank. The amount of advance of flight 15 from aft end 17 to forward end 16 is constant along the length of longitudinal axis 12.

A pair of stabilizer plates 18 and 19 are pivotally mounted together and extend into tank 11 where they are pivotally driven by a pair of motors. Stabilizer plates 18 and 19 may be pivoted outward such as shown by the dashed line positions 22 and 23 in FIG. 2. The plates extend outwardly to provide directional stability to the hydro-rotor and to counter the natural turning moment created by the rotating tank 11 or flight 15. Thus, stabilizer plates 18 and 19 must have sufficient size and weight to allow the hydro-rotor to proceed in a direct line along axis 12 as tank 11 is rotated and the plates are extended. Likewise, movement of plates 18 and 19 are independent of each other and thus may be extended at different angles to allow control of the direction of movement of the hydro-rotor. In other words, angle 24 extending between the vertical and the dashed line position 22 of plate 18 may be different than angle 25 which extends between vertical and the dashed line position 23 of plate 19. Each plate has an outward turned distal end perpendicularly joined to the main body of the plate. Thus, plate 19 has a forward proximal end 26 and an aft proximal end 27 pivotally mounted to the tank 11. Likewise, plate 18 has a forward and aft proximal end pivotally mounted to tank 11.

Located at both ends 13 and 14 of tank 11 are a pair of axles with one such axle 28 shown in the fragmented view of FIG. 3. An identical axle is located at the aft end of tank 11. Thus, the following description of axle 28 and end 13 of tank 11 applies equally to the aft end 14 and the associated axle. The forward axle 28 extends into tank 11 with the inner end of the axle 28 extending into a conventional electric motor 30. The aft axle extends into tank 11 with the inner end of the axle extending into an identical electrical motor. An electric power source 32 is electrically connected to motor 30 and the second motor positioned in the aft end of the tank via wiring 37 to cause the rotors thereof to rotate within the stators affixed to the tank. An alternate embodiment is identical to the embodiment shown in FIG. 3 except power source 32 is located externally of the tank being mounted to an external frame and is connected to the motor stator by optional wires 37a which extend through the common compound axle consisting of cylindrical portions 42, 45 and 46.

Motor 30 will now be described it being understood that an identical description applies to the second motor positioned in the aft end of the tank. Motor 30 includes a frame 113 affixed to tank 11 with the stator 33 affixed to frame 113. The rotor 34 is mounted to axle 28 and rotates therewith within the stator 33. Electric power source 32 may be of any type including battery, nuclear power, or engine/generator combinations. Conventional bearings are mounted within the forward and aft ends 13 and 14 of the tank to allow the flight to rotate about tank 11.

As shown in FIG. 1, the flight is spaced apart from the outside surface of the tank between the opposite ends 13 and 14 thereby allowing relative rotational motion between the flight and tank main body. The opposite end of axle 28 is rotatably received in a socket provided in the tank and has a gear 40 in meshing engagement with an annular gear 41 formed on and facing radially outward on inwardly extending portion 42 of flight 15. Thus rotation of rotor 34 and axle 28 results in rotation of gear 40 thereby causing rotation of flight 15 and propelling the ship through water. The aft end of flight 15 is configured as the forward end of flight and is driven in an identical manner. Tank 11 is fixedly mounted to the stator 33 and thus the tank main body does not rotate about the longitudinal axis.

A pair of annular outwardly facing gears 43 and 44 are formed respectively on the inwardly extending portions 45 and 46 of stabilizer plates 19 and 18. Gears 43 and 44 are in meshing engagement respectively with gears 47 and 48 connected respectively to the output shafts 49 and 50 of electric motors 51 and 52 fixed to the tank 13 and which are operable to angularly position the stabilizer plates.

Coupling 95 is optionally mounted to the motor frame and axle 28. Coupling 95 is used to cause tank 11 to rotate with flight 15. The coupling 95 includes an outer casing 112 fixedly mounted to the axially extending legs of frame 113 of electric motor 30 to prevent relative motion therebetween. Axle 28 affixed to rotor 34 extends into casing 112 and is affixed to driver gear 114 in meshing engagement with a follower gear 115 rotatably mounted within the casing 112. Gear 115 in turn is in meshing engagement with a continuous cylindrical inwardly facing gear surface 116. Thus, rotation of axle 28 results in rotation of gears 114 and 115 and thus rotation of casing 112 and tank 11 along with flight 15. Tank 11 rotates in a direction opposite to the rotation of flight 15. A conventional clutch 117 is mounted to casing 112 and is operable to move gear surface 116 of casing 112 to the left as viewed in FIG. 3 to disengage follower gear 115 from gear surface 116 and thereby allow rotor 34 to drivingly rotate the flight 15 while the tank 11 remains in a non-rotational mode.

The preferred embodiment of hydro-rotor 10 depicted in FIG. 1 has a variety of uses including use as a torpedo. Likewise, the hydro-rotor may be used as a toy with power source 32 being a plurality of batteries. Further, hydro-rotor 10 can be used as a power generator by placing the tank main body into a flowing water stream with the water stream then impinging upon flight 15 causing rotation of the flight and the tank around the longitudinal axis. In such a case, the electric motors are replaced with electric generators and power source 32 is replaced by an exciter generator which produces direct current on the stator with the remaining structure remaining the same as shown for the embodiment of FIG. 1 except as described herein. Stabilizer 18 and 19 are fixed to a frame fixed to the ground. Thus, as the stream causes rotation of the flight without tank 11 coupled thereto via coupling 95 the rotaty motion of the flight is converted by generators into electrical energy which is then directed by conventional circuitry outward from the tank to a storage depot along the hollow central common compound axle via wires **37*a* (FIG. 3). Alternatively, the flight may be coupled to the tank via coupling 95** causing the tank to rotate in the opposite direction of the flight thereby increasing the amount of electrical energy generated which is then directed outward in the same manner.

Figure 4:
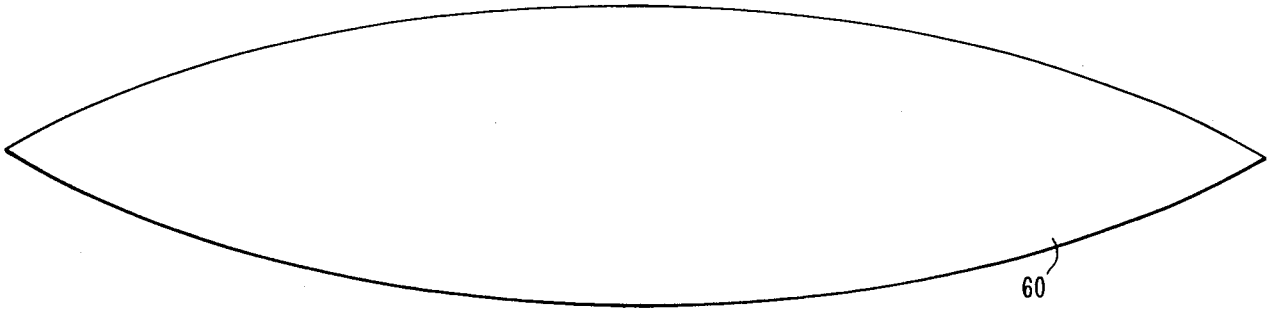
FIG. 4 is a plan view of a ship incorporating a plurality of the hydro-rotors.
Figure 5:
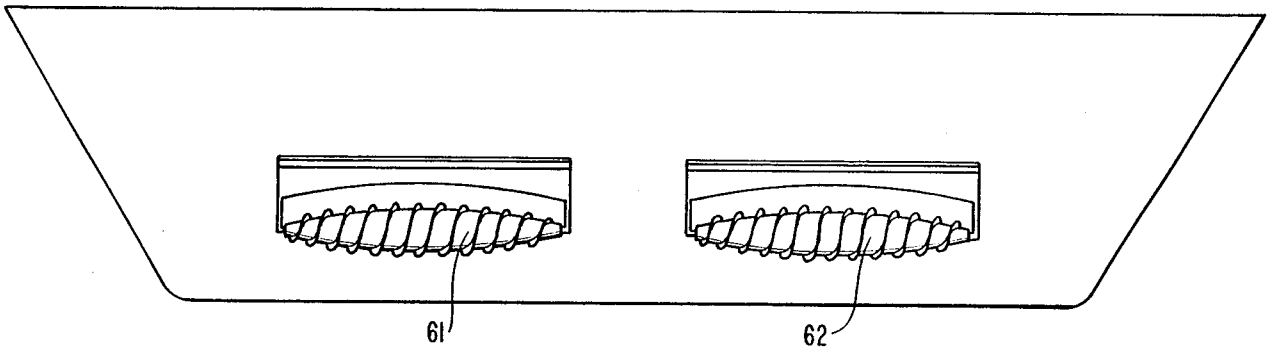
FIG. 5 is a side view of the ship of FIG. 4.
Figure 6:
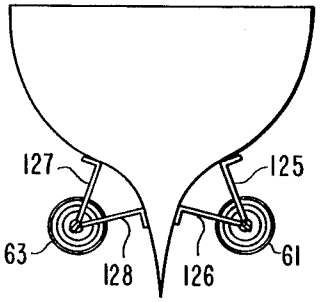
FIG. 6 is an end view of the ship of FIG. 5.

The hydro-rotor may be utilized to propel an object such as a ship depicted in FIGS. 4–6. The hydro-rotors may be positioned along the longitudinal axis of the ship thereby allowing a hydrodynamic contoured external configuration for the ship main body. That is, ship 60 may include a tapered forward end and a tapered aft end thereby decreasing the drag of the ship and minimizing the turbulence caused by the ship moving through the water. Ship 60 includes four such hydro-rotors with two hydro-rotors 61 and 62 (FIG. 5) shown mounted on one side of the ship with an identical pair of hydro-rotors mounted on the opposite side of the ship, with two hydro-rotors 61 and 63 depicted in FIG. 6. The hydro-rotors mounted to ship 60 include two forward hydro-rotors 61 and 63 located midway between the forward edge of the ship and the midpoint of the ship, whereas the aft hydro-rotors are located aft of the midpoint of the ship midway between the midpoint of the ship and the aft section of the ship. The hydro-rotors utilized in ship 60 are identical to hydro-rotor 10 with the exception that stabilizer plates may be deleted or may be secured fixedly to the ship thereby fixing the hydro-rotor to the ship frame. FIG. 6 depicts the distal ends of stabilizer plates 125 and 126 of hydro-rotor 61 and the distal ends of stabilizer plates 127 and 128 of hydro-rotor 63 fixed to the ship. The electric power source for driving the electric motors to rotate the hydro-rotor may be located either within each hydro-rotor or may be located within the ship.

Figure 7:
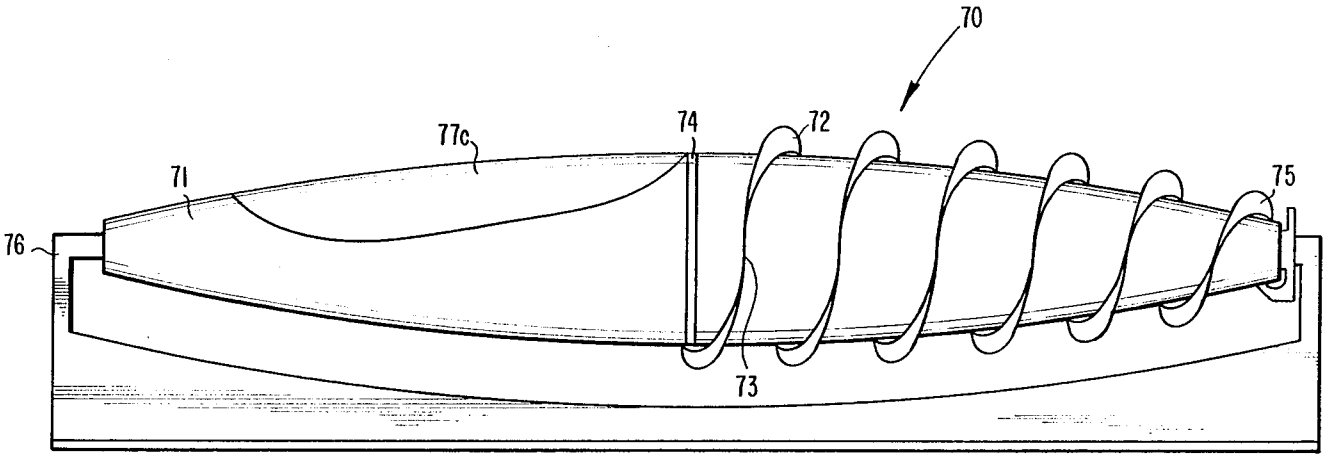
FIG. 7 is a side view of another ship incorporating an alternate embodiment of the hydro-rotor.
Figure 8:
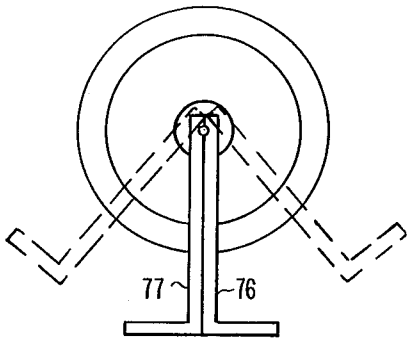
FIG. 8 is an end view of the ship of FIG. 7.

Yet a further embodiment of the hydro-rotor is shown in FIGS. 7 and 8 which takes the form of a small ship or submarine. Ship 70 includes a tank 71 which is hydrodynamically contoured having a longitudinal axis and being shaped with a forward and rear pointed end to provide low drag when positioned in water and relative motion exists between the tank and the water. Helical flight 72 extends only from the midpoint of the tank to the aft end and extends circumferentially around the aft half-portion of the tank. The flight has an outside diameter larger than the tank, but is generally not in contact with the outer surface of the tank. Instead, the forward end 73 of the flight is fixedly fastened to ring 74 rotatably mounted by a suitable bearing to tank 71. The opposite end or aft end 75 of the flight is mounted in an identical manner to that previously described for the FIG. 3 embodiment. Thus, flight 72 is free to rotate relative to tank 71 with the aft end 75 of the flight being connected and driven by axle 28 as previously described. Axle 28 is connected to a rotor in turn positioned within a motor 30 mounted within the tank. A pair of stabilizer plates 76 and 77 are provided and are identical to plates 18 and 19 and operate in the same manner. A payload compartment **77*c* is provided in tank 71**.

Many variations of the present invention are contemplated and included herein with the following description providing various alternate embodiments. The hydro-rotor may be utilized with boats, vessels, submarines, torpedoes, flat heliboats, hydroelectric generators, pumps and other devices, and toys. In boats, the tank contains a motor, common axle and cabin with plastic cover. The flight is helical and rotates about the tank with an end fixed to the end of the axle with the other end fixed to a ring that rotates on rails about the tank. As the boat has a hydrodynamic profile, no pressure, suction, turbulence, or noise caused by turbulence is present, especially at the rear end of the boat. Noise from the motor is minimal since it is placed in a separated compartment of the tank. Higher speed may be obtained since there is no pressure, suction or turbulence acting against the boat movement. In comparison with conventional propellers, no turbulence, or noise caused by turbulence is produced by the helical strip; instead, higher speed is obtained since the strip action is exerted on a larger volume of water. The longitudinal, transversal, and directional stability is much better than in conventional boats since the surface of stabilization is larger. When the stabilizer is opened to a convenient angle, the boat can sail in shallow water or it can be placed anywhere out of the water in a safe manner.

In vessels, two hydro-rotors have been fixed in line to the keel of a hydrodynamic vessel. In this case, a helical strip, fusiform tank, and the common compound axle consisting of the cylinders 42, 45 and 46 rotate as a whole. By a fusiform tank, it is meant a tank having an outside surface defined by the perimeters which inscribe the common area of two identically sized circles. Hydro-rotors are driven by a line of relatively small electric generator motors placed inside, along the keel of the vessel, and by electric motors placed inside of the tank. Since the shape of the vessel is hydrodynamic according to the horizontal plane, the vessel is hydrodynamic according to the horizontal plane, the vessel has no stern. Thus, it can move in opposite directions without pressures, turbulence or noise caused by turbulence just by reversing the rotation of the hydro-rotors. A decisive characteristic for battleships.

In submarines and torpedoes, the stators of electric motors must be fixed to the inner side of the fusiform tank with rotors fixed to the common compound axle (as previously defined), which, in turn must be fixed to the stabilizers. In this case, longitudinal, transversal and directional stabilization are interdependent. Gases or liquids contained at high pressure could also provide action-reaction influence as a driven force for rotation or additional linear velocity.

In flat heliboats, two relatively large hydro-rotors are placed under a floating platform. A mechanism similar to that of the landing gear of airplanes makes the hydro-rotors move from a given separation to a more convenient one. Variable floating effects and stability can be obtained. The floating platform may or may not have hydrodynamic shape according to the horizontal plane.

In hydroelectric generators, the hydro-rotors containing dynamos are submerged or partially submerged in a water stream. The helical strip attached to the tank is rotating with rotors attached to the inner part of the tank. The common axle does not rotate, except the flight driver, and is fixed to the stabilizer which in turn is fixed to a frame that does not interfere with the stream. The stators are fixed to the common axle.

Toys may be built from plastic utilizing the hydro-rotor. The toy may take the form of a submarine by filling the tank with water and by adding to the stabilizer small thin rectangular magnets (stabilizer should be made partially from iron) in order to vary the total density of the toy in relation to that of water. The driven force may be provided by a longtudinal spring wound about the axle, or small sealed batteries, electric motors and rudders under radio remote control depending on the price of the toy.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A hydro-rotor comprising:

a hydrodynamically contoured tank having a longitudinal axis and being shaped with forward and rear pointed ends to provide low drag when positioned in water and relative motion exists between said tank and said water;

a helical flight positioned on said tank and extending circumferentially around at least a portion thereof, said flight having an outside diameter larger than said tank:

stabilizer means mounted to and extending between said forward and rear pointed ends and extenable outwardly of said flight at controlled radial positions to stabilize directional movement of said tank as said flight rotates; and, power means connected to said flight and said tank and operable in a first state wherein said flight rotates around said tank and a second state wherein said flight and said tank rotate simultaneously about said longitudinal axis.

2. The hydro-rotor of claim 1 and further comprising:

control means connected to said stabilizer means and said tank being operable to move said stabilizer means through a predetermined angle about said longitudinal axis to said radial positions.

3. The hydro-rotor of claim 2 wherein:

said stabilizer means includes a pair of plates with proximal ends pivotally mounted to said forward and rear ends of said tank and distal ends which extend outward of said flight along said longitudinal axis, said control means is operable to move said distal ends apart providing a pair of guide surfaces stabilizing said tank as said flight rotates.

4. The hydro-rotor of claim 1 wherein:

said flight is movably mounted to said tank allowing relative motion therebetween; and, said power means is mounted within said tank and includes a rotary member mounted in said tank and connected to said flight being operable to rotate said flight about said tank.

5. The hydro-rotor of claim 4 and further comprising:

control means connected to said stabilizer means being operable to move said stabilizer means through a predetermined angle about said longitudinal axis to said radial positions.

6. The hydro-rotor of claim 5 wherein:

said stabilizer means includes a pair of plates with proximal ends pivotally mounted to said forward and rear ends of said tank and distal ends which extend outward of said flight along a portion of said longitudinal axis, said control means is operable to move said distal ends apart providing a pair of guide surfaces stabilizing said tank as said flight rotates.

7. A ship comprising:

a ship frame with an external tapered front end and an external tapered back end to provide low drag when moved through water; and, a plurality of hydro-rotors mounted to said ship frame and each including a hydrodynamically contoured tank having a longitudinal axis and being shaped with forward and rear pointed ends to provide low drag when moved in water and relative motion exists between said tank and said water, said hydro-rotors each including a helical flight positioned on said tank and extending circumferentially around at least a portion thereof, said flight having an outside diameter larger than said tank, and, power means connected to said flight and said tank and operable in a first state wherein said flight rotates around said tank and a second state wherein said flight and said tank rotate simultaneously about said longitudinal axis.

8. The ship of claim 7 wherein:

said flight is movably mounted to said tank allowing relative motion therebetween; and, said power means includes a rotary member operable to rotate said flight about said tank.

9. A hydro-rotor comprising:

a pair of stabilizer plates movable apart to different angular positions in a fluid;

a hollow tank with a longitudinal axis and having a pair of opposite tapered ends movably mounted to said pair of stabilizer plates which provide directional stability to said tank along said longitudinal axis;

a helical flight movably mounted to said tank and extending therearound to propel said tank through said fluid in a direction along said axis as said flight is rotated;

power train means within said tank being connected to said flight and said tank and operable when in a first state to rotate said flight around said tank and when in a second state to simultaneously rotate said flight and rotate said tank about said longitudinal axis.

10. The hydro-rotor of claim 9 wherein:

said power train means includes a first member fixedly mounted to said tank and a second member rotatbly mounted and driven within said first member, said second member connected to said flight to propel said tank through said fluid.

11. The hydro-rotor of claim 10 wherein:

said power train means includes a disengageable coupling to connect said second member to said tank and includes a first position whereat said second member is not connected to said tank with said power train means rotating said flight about said tank and a second position whereat said second member is connected to said tank with said power train means rotating said flight with said tank about said axis.

12. The hydro-rotor of claim 11 wherein:

said power train means includes an electric motor with said first member being a stator and said second member being a rotor within said stator.

13. The hydro-rotor of claim 12 and further comprising:

control means mounted within said tank to move said stabilizer plates: and wherein:

said stabilizer plates include opposite mounting portions which extend into said tank each including a control surface thereon operatively engaged with said control means to pivot said plates to a tank stabilizing position.

14. The hydro-rotor of claim 13 wherein:

said power train means is operable to allow said flight to rotate in a direction opposite of rotation of said tank.

15. The hydro-rotor of claim 14 wherein:

said flight includes cylindrical ends projecting into said tank and rotatably mounting said flight thereto, said cylindrical ends are hollow through which said opposite mounting portions of said stabilizer plates extend cooperatively forming with said cylindrical ends a passage leading from externally of said tank to inside said tank.

16. A hydro-rotor comprising:

a hollow tank having a pair of opposite tapered ends and a longitudinal axis;

a helical flight movably mounted to said tank and extending therearound; and, means connected to said flight and said tank and operable in a first state wherein said flight rotates around said tank and a second state wherein said flight and said tank rotate simultaneously about said longitudinal axis.

17. The hydro-rotor of claim 16 wherein:

said means includes a first member fixedly mounted to said tank and a second member rotatably mounted and driven within said first member, said second member connected to said flight to propel said tank through fluid.

18. The hydro-rotor of claim 17 wherein:

said means includes a disengageable coupling to connect said second member to said tank and includes a first position whereat said second member is not connected to said tank with said means rotating said flight about said tank and a second position whereat said second member is connected to said tank with said means rotating said flight with said tank about said axis.

* * * * *